United States Patent [19]

LaHaye et al.

[11] 4,332,295

[45] Jun. 1, 1982

[54] COMPOSITE CERAMIC HEAT EXCHANGE TUBE

[75] Inventors: Paul G. LaHaye; John W. Bjerklie; Robert A. Penty, all of Cape Elizabeth, Me.

[73] Assignee: Hague International, South Portland, Me.

[21] Appl. No.: 150,888

[22] Filed: May 19, 1980

[51] Int. Cl.[3] ..... F28F 21/04

[52] U.S. Cl. ..... 165/178; 165/180; 165/DIG. 8

[58] Field of Search ..... 165/133, 178, 180, DIG. 8

[56] References Cited

U.S. PATENT DOCUMENTS

| | | | |
|---|---|---|---|
| 3,270,780 | 9/1966 | Kydd et al. | 165/177 |
| 3,376,028 | 4/1968 | Leason et al. | 165/172 |
| 3,493,042 | 2/1970 | Burne et al. | 165/180 |
| 4,060,379 | 11/1977 | La Haye et al. | 432/179 |

*Primary Examiner*—Sheldon J. Richter
*Attorney, Agent, or Firm*—Wolf, Greenfield & Sacks

[57] ABSTRACT

The heat exchange tube has a porous thermal shock resistant outer shell composed of a corrosion resistant ceramic material that may have a finned outer surface or a plain cylindrical outer surface. The outer shell contains an inner tube composed of a dense nonporous ceramic which is capable of containing high pressure gases, but which may not be as thermally shock resistant or corrosion resistant as the outer shell. The inner tube is formed of a dense ceramic material such as a highly dense silicon carbide or silicon nitride having at each end a like density insert. The end inserts provide sealing surfaces to contact other components in the heat exchanger such as identical ceramic tube assemblies to form a gas-type pressure seal. The inner tube can be fabricated by a deposition technique such as a chemical or physical vapor deposition, and alternatively, can be made separately and press fitted into the outer shell or the outer shell can be cast or otherwise formed around the inner tube. As an alternative solution, the dense inner tube and end seals can be integrated into a single component performing the functions of all three components, i.e., the two end seals and the inner tube.

15 Claims, 7 Drawing Figures

COMPOSITE CERAMIC HEAT EXCHANGE TUBE

BACKGROUND OF THE INVENTION

The present invention relates in general to a heat exchange tube and pertains more particularly to a composite ceramic heat exchange tube of the type that may be applied to a closed cycle of externally fired gas turbine wherein the energy for the gas turbine cycle is transferred from a high temperature gas stream through the heat exchanger to the working fluid of the gas turbine which in the case of an externally fired open cycle gas turbine would be atmospheric air at elevated pressures and temperatures.

U.S. Pat. No. 4,060,379, issued Nov. 29, 1977 and assigned to the same assignee as the instant invention discloses an energy conserving process furnace employing a recuperator, including a plurality of mounted heat exchange tubes. This patent describes a heat exchange tube construction with adequate end sealing surfaces for the pressure range employed therein which may be in the order of 200 psia. However, for the higher pressure range, the pressure containing capability and the sealing between tubes provided by this prior art construction may not be adequate. The heat exchange tube of this invention is particularly adapted for use with gas turbine system operating over 650° C. average turbine inlet temperature and pressures up to possibly exceeding 500 psi or 34 atmospheres.

Accordingly, one object of this present invention is to provide an improved ceramic heat exchange tube design, that readily withstands pressures within the tube of up to or exceeding 34 atmospheres. In accordance with the present invention, this is accomplished by means of the fabrication of a composite tube having both low wall leakage characteristics, good end sealing characteristics, and at the same time being able to withstand substantial thermal shock and a chemical attack or corrosion.

Another object of this present invention is to provide an improved ceramic heat exchange tube of composite construction and which is presently composed entirely of ceramic materials including an outer portion configured to expose a large amount of surface to a gas stream of a first type ceramic material and an inner portion of a higher density ceramic material to enclose a second gas stream at a high pressure.

A further object of this invention is to provide a tubular configuration having an extended outer surface such as a finned surface to expose an optimal amount of convection heat absorbing surface to the gas flowing over the external surfaces of the tube.

A further object of the present invention is to provide an improved ceramic heat exchange tube of composite construction and one which is both capable of containing high pressure fluids and able to withstand substantial thermal shock. Another object of the present invention is to provide an improved ceramic heat exchange tube construction employing end pieces which preferably comprise a male end piece and a female end piece of almost fully dense ceramic material thus being capable of accepting a high polish to provide an improved sealing surface between adjacent tubes or other fluid conducting components of the heat exchanger assembly.

A further object of this invention is to provide an outer ceramic material particularly suited to resist high temperature chemical attack of the products of combustion which are produced by ash bearing fuels such as coal, peat, lignite, and city refuse.

SUMMARY OF THE INVENTION

To accomplish the foregoing and other objects of this invention there is provided a composite heat exchange tube which comprises a main tube body of a high temperature resistant material, preferably constructed of a porous thermal shock resistant ceramic outer shell and an inner tube means provided in one or more sections including two end sealing means; wherein, the inner tube, the seals and the outer shock resistant containing shell are all thermally and chemically compatible throughout the operating range of the heat exchanger. The inner tube means is concentrically disposed within the main tube body and the end means form a sealing joint at opposite ends of the tube to mate with tubes or components, having matching sealing means. The end means are capable of being highly polished to form a high pressure sealing surface. The ends of the ceramic tube typically seal to an adjacent like tube or an end adapter such as described in U.S. Pat. No. 4,060,379. The inner tube means is constructed of a more dense material than the main tube body and is thus less porous than the main tube body to provide a surface which can be polished and a containment vessel for high pressure gas such as helium that has small molecules which can readily penetrate porous walls. It is the intention of this invention to provide a composite tube optimized geometrically for gas to gas heat transfer which displays the characteristic of being capable of containing high pressure gases and yet will also be able to stand thermal shock and corrosion. In accordance with the invention, the inner tube or liner is preferably constructed of a ceramic material having a density of more than 85% of full density. The main tube body also of a ceramic material preferably has a density of at least 80% of full density, but less than the density of the inner liner or seals. The liner and the end seals may be of substantially the same density but preferably the end seals are of greater density than the inner liner because the end seals require polishing to a surface finish of 4 to 65 micro-inches roughness height to provide an optimum seal and thereby contain the high pressure gas.

The inner tube or liner may be constructed of silicon carbide, silicon nitride or similar ceramic materials. The silicon carbide that is selected is preferably of a density of in the order of 3.0 grams per cubic centimeter. Where silicon nitride is used, it similarly has a density of the order of 3.0 grams per cubic centimeter. It is preferred that the inner tube or liner have a density greater than 85% of theoretical full density. For some lower temperature applications, it is possible that the inner liner can also be constructed of metal having a thermal coefficient of expansion which is compatible with the ceramic material in the outer shell.

In accordance with the invention, there is also provided a method of fabricating a composite heat exchange tube having a porous thermal shock resistance ceramic main tube body for the passage internally of heated gas or air at temperatures of ambient to say 1900° F. This method comprises the steps of providing ceramic end inserts which are to form a seal at each end of the heat exchange tube and which are made of a more dense ceramic material than the main tube body. These inserts are disposed in respective ends of the main tube body and there is preferably then a thin ceramic liner deposited within the main tube body which liner is substantially impervious to fluids flowing within the tube at pressures at least up to 500 psi. The liner is formed in many different ways such as by the use of vapor deposition, either physical or chemical, a glazing operation, plating, sputtering, flame spraying, or electro-static deposition. Furthermore, the liner may be formed separately and later inserted into the main tube body.

The entire heat exchange tube is preferably made of ceramic which provides resistance to high temperatures encountered in the gas stream which can be all the way from ambient even up to 3200° F. at the same time providing for good heat transfer. Most ceramics have low thermal conductivity with the exception of silicon carbide and silicon nitride which are preferred for use in the ceramic heat exchanger of the present invention. Other ceramics can be used having a thermal conductivity of at least 3 BTU/hr/ft$^2$/°F./ft. For example, the main tube may be cast from a commercially available castable silicon carbide such as Carbofrax 11, a product of the Carborundum Company of Niagara Falls, New York. This product is typically mixed with water and cast to a desired shape and then fired to temperatures over 1800° F. to develop strength and good thermal conductivity. The castable silicon carbide may also use a material such as calcium-alluminate as a binder. This silicon carbide material may be cast at room temperature and allowed to cure at room temperature. It may then be preheated for a period of time and then fired at say 2100° F. for a period of hours.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
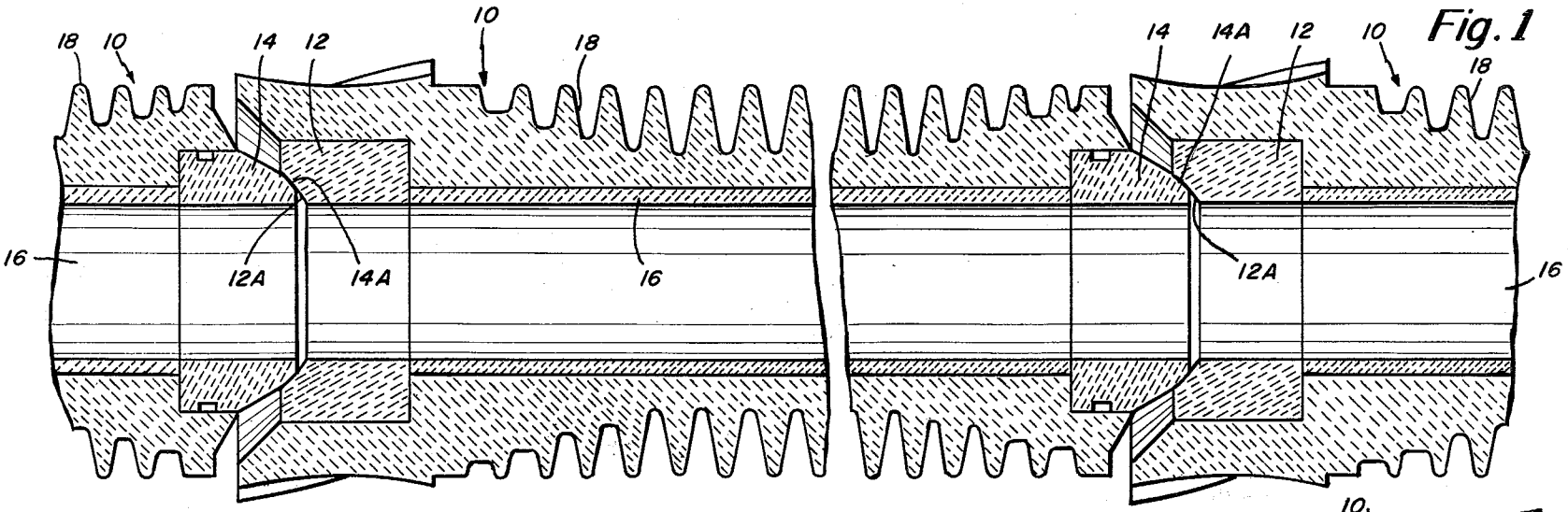
FIG. 1 is a cross-sectional view of a composite heat exchange tube constructed in accordance with the principles of this invention.
Figure 5:
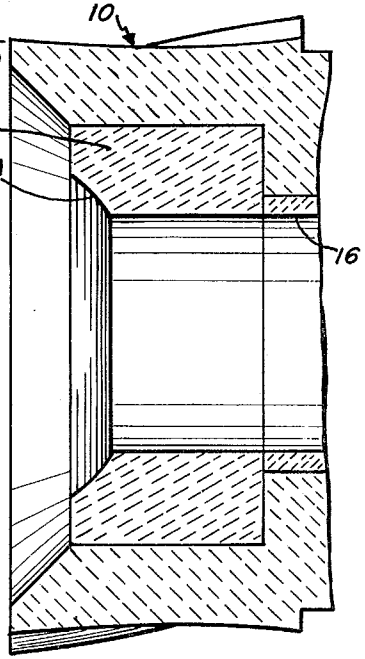
FIG. 5 is a somwhat enlarged cross-sectional fragmentary view showing the detail of the female end of a tube in accordance with the invention.
Figure 4:
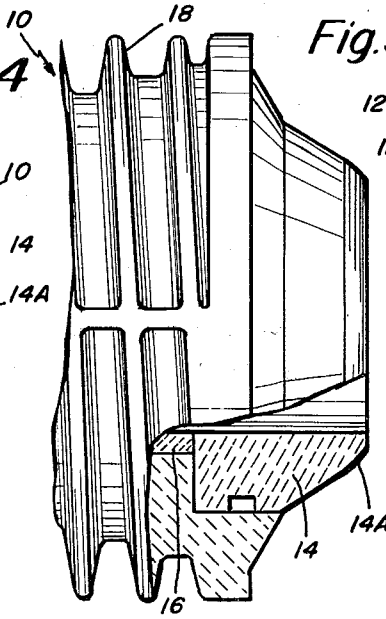
FIG. 4 is a somewhat enlarged partially cross-sectional view through a portion of the male end of the tube in accordance with the invention.
Figure 3:
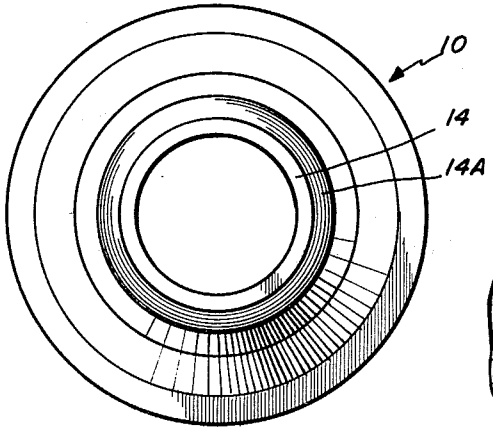
FIG. 3 is a right end view facing longitudinally of the tube of FIG. 1.
Figure 2:
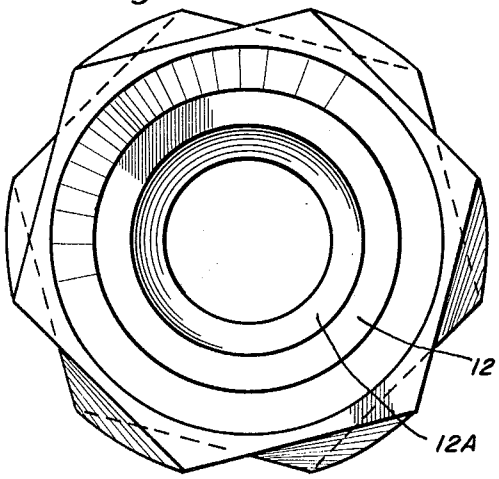
FIG. 2 is a left end view facing longitudinally of the tube of FIG. 1.

The drawing shows one form of heat exchange tube constructed in accordance with the principles of this invention. This tube may be employed in an application such as the one described in U.S. Pat. No. 4,060,379 wherein a plurality of such tubes are provided in a bank forming part of a recuperator used in an energy conserving process furnace. The tube of this invention is more specifically used in association with an externally fired gas turbine system employing as a source of thermal energy the gaseous products of combustion produced by the burning of coal, lignite, wood and other fuels, such gases entering the heat exchanger at temperatures as high as 3200° F. and flowing over the outside surface of the tubes. The higher pressure air enters the tube bore, typically at temperatures above 250° F. and at pressures as high as 34 atmospheres. This air is heated and exits from the heat exchanger at temperatures as high as 2500° F. In accordance with the invention, the tube is constructed preferably as a composite heat exchange tube having the characteristics both of being capable of containing high pressure gas (air) and being able to withstand substantial thermal shock. The capability of containing the high pressure gas is borne primarily by the inner portion of the tube while the outer portion of the tube is constructed to satisfy the other characteristics of being able to withstand substantial thermal shock and resistance to corrosion. In this connection the tube is preferably totally constructed in ceramic with different portions being of different density ceramic so as to satisfy the different desired characteristics of the tube while being compatible thermally and chemically.

The drawing depicts a composite ceramic heat exchange tube in a schematic fashion including a main tube body 10, male insert member 14, female insert member 12, and inner tube or liner 16. The main tube body 10 is preferably in the form of a porous thermal shock resistant outer shell having a cylindrical external surface or the extended surface arrangement shown in the drawing including fins 18 on the outer surface of the main tube body.

The porous main tube body 10 is used for resistance to thermal shock and the material from which this body is made is selected to resist chemical attack at high temperatures. As mentioned previously the main tube body is preferably made in the form of a casting employing, for example, a commercially available castable silicon carbide. The main body may also be constructed of certain alloys of silicon carbide or silicon nitride or other similar ceramics. The main body again protects the inner liner from thermal shock and may also protect the inner liner from corrosion. It is preferred that the main body have a density in the range of 2.2–3.0 grams per cubic centimeter. Full dense silicon carbide has a density of 3.2 per grams cubic centimeter while fully dense silicon nitride has a density of 3.18 grams per cubic centimeter. Thus the main outer body has a density usually in the order of at least 80% of full density, but less than the density of the liner or the inserts which have a density above: 85 of full density.

The inner tube or liner 16 is shown in the drawing of substantial thickness but in a preferred embodiment this may be constructed by a deposition process such as chemical or physical vapor deposition to provide a thickness of the liner possibly down to as thin as 5 microns. The maximum thickness of the liner is usually on the order of ¼". The inner liner 16 extends essentially the entire length of the heat exchange tube and in the drawing it is shown terminating at the inserts 12 and 14. The inner liner with the male and female inserts may be made of one single component performing the functions of all three dense components which are shown in FIG. 1.

The sealing surface typically has a surface finish of between 4 and 65 microinches roughness height.

In an alternate arrangement the inner tube can be fabricated separately from the outer body and that can also by press fit into the inner body or possibly even fit in a looser fashion with the outer body at the expense of some deterioration in heat transfer capability.

In still another method of fabrication, the inner tube can be fabricated separately and considered as the basic substrate, being in the form of a core which is permanently encapsulated by the outer body to form the outer body. For example, the inner tube can be placed in a mold and the ceramic material to form the outer tube may be cast thereabout in accordance with standard casting practice. The complete composite tube may then be removed from the mold and fired.

Figure 6:
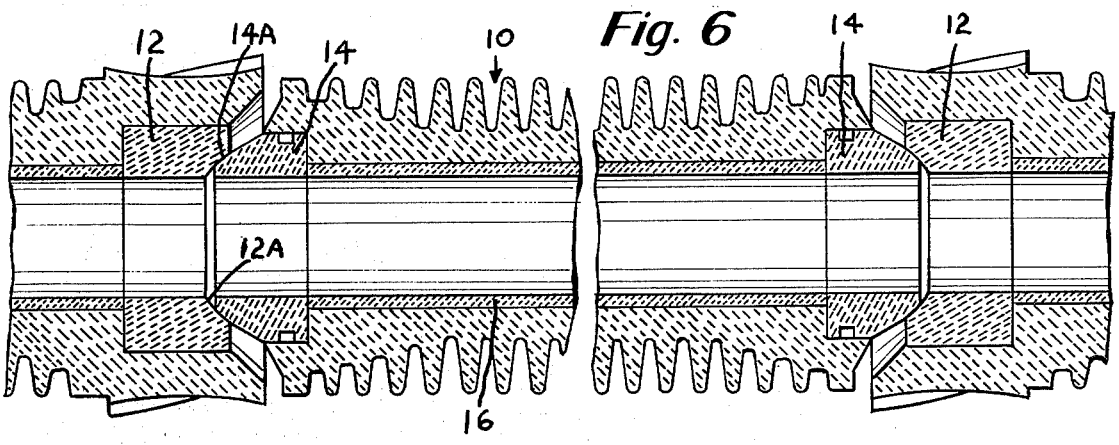
FIG. 6 is a cross-sectional view of an alternate composite heat exchange tube construction employing two male inserts.
Figure 7:
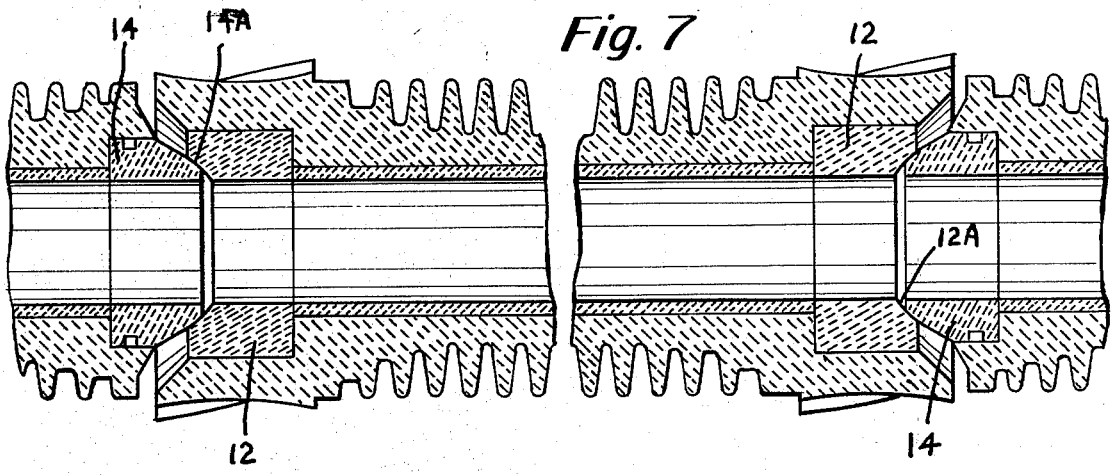
FIG. 7 is a cross-sectional view of an alternate composite heat exchange tube construction employing two female inserts.

FIGS. 6 and 7 show further possible embodiments of the present invention. Both of these arrangements are substantially the same as depicted in FIG. 1 with the exception of the inserts 12 and 14. In the embodiments of FIG. 1 in the main tube 10 at the center there is provided at one end a female insert 12 and at the other end the male insert 14. In FIG. 6 male inserts 14 are provided at both ends and these mate, of course, with corresponding female inserts and adjacent tubes. In FIG. 7 both of the inserts are female inserts 12 and these would, of course, interconnect with male members of adjacent tubes or possibly even male members of some other type of holding structure other than adjacent tube. Likewise, in the embodiments of FIGS. 1 and 6 the tube can be held at an end by a holder or the like which is typically provided, one at each end of a tube string. If a single tube is being supported, such as the one depicted in FIG. 1, then a male holder is provided at the left end and a female holder at the right end. All of the techniques for construction discussed with regard to FIG. 1 can also equally be applied in constructing tubes as depicted in FIGS. 6 and 7.

Having described a limited number of embodiments of the invention, it is now contemplated that numerous other embodiments will fall within the scope of the invention as defined by the appended claims.

What is claimed is:

1. A composite heat exchange tube comprising;

a main tube body of a high temperature resistant material, and an inner tube means disposed within the main tube body and having end means disposed within the main tube body and having end means forming a sealing joint at opposite ends of the tube, said end means capable of being highly polished to form a high pressure sealing surface, said main tube body being constructed of a somewhat porous thermal shock resistant ceramic, and said inner tube means being constructed of a more dense material than the main tube body and less porous than the main tube body, said inner tube means is constructed of a ceramic material having a density greater than that of the main tube body and substantially impervious to fluids up to at least 500 p.s.i. within the tube.

2. A composite heat exchange tube as set forth in claim 1 wherein the inner tube means comprises silicon carbide at a density on the order of 3.0 grams/c.c.

3. A composite heat exchange tube as set forth in claim 1 wherein the inner tube means comprises silicon nitride at a density on the order of 3.0 grams/c.c.

4. A composite heat exchange tube as set forth in claim 1 wherein the main tube body has a density greater than 80% of full density.

5. A composite heat exchange tube comprising;

a main tube body of a high temperature resistant material, and an inner tube means disposed within the main tube body and extending substantially the length thereof, and having end means forming a sealing joint at opposite ends of the tube, said end means capable of being highly polished to form a high pressure sealing surface, said end means comprising separate end means each in the form of an insert means, said main tube body being constructed of a somewhat porous thermal shock resistant ceramic, and said inner tube means being constructed of a more dense material than the main tube body and less porous than the main tube body.

6. A composite heat exchange tube as set forth in claim 5 including a plurality of heat exchange tubes.

7. A composite heat exchange tube as set forth in claim 5 including means mating with said end means at at least one end of the tube and including bias means for forced engagement with the ends.

8. A composite heat exchange tube as set forth in claim 5 wherein the surface finish in microinches roughness height of the end means sealing surface is less than the surface finish of the main tube body or inner tube means.

9. A composite heat exchange tube as set forth in claim 5 wherein the surface finish in microinches roughness height of the end means sealing surface is in the range of 4–65.

10. A composite heat exchange tube as set forth in claim 5 wherein the insert means includes male inserts at both ends of the inner tube.

11. A composite heat exchange tube as set forth in claim 5 wherein the insert means includes female inserts at both ends of the inner tube.

12. A composite heat exchange tube as set forth in claim 5 wherein the insert means includes a male insert at one end of the inner tube and a female insert at the other end of the inner tube.

13. A composite heat exchange tube as set forth in claim 12 wherein the inner tube means is constructed of a ceramic material having a density of at least 85% full density.

14. A composite heat exchange tube as set forth in claim 13 wherein the main tube body has a density of at least 80% full density and less than the density of the inner tube means.

15. A composite heat exchange tube as set forth in claim 14 wherein the density of the end means is greater than the density of the inner tube.

* * * * *